US008492915B2

(12) United States Patent
Koeppen et al.

(10) Patent No.: US 8,492,915 B2
(45) Date of Patent: Jul. 23, 2013

(54) DEVICE AND METHOD FOR CONVERTING SUPPLIED ELECTRICAL POWER INTO MECHANICAL POWER TO START AT LEAST ONE ENGINE

(75) Inventors: Carsten Koeppen, Rellingen (DE); Till Marquardt, Hamburg (DE); Sebastian Thiel, Buxtehude (DE)

(73) Assignee: Airbus Operations GmbH, Hamburg (DE)

( * ) Notice: Subject to any disclaimer, the term of this patent is extended or adjusted under 35 U.S.C. 154(b) by 528 days.

(21) Appl. No.: 12/754,809

(22) Filed: Apr. 6, 2010

(65) Prior Publication Data

US 2010/0252688 A1 Oct. 7, 2010

Related U.S. Application Data

(60) Provisional application No. 61/166,861, filed on Apr. 6, 2009.

(51) Int. Cl.
*F02N 11/04* (2006.01)

(52) U.S. Cl.
USPC ..... 290/36 R

(58) Field of Classification Search
USPC ..... 290/36 R, 43–44, 54–55
See application file for complete search history.

(56) References Cited

U.S. PATENT DOCUMENTS

| | | | | |
|---|---|---|---|---|
| 1,669,576 | A * | 5/1928 | Schenkel | 363/150 |
| 1,693,296 | A * | 11/1928 | Hull | 318/735 |
| 2,061,983 | A * | 11/1936 | Rossman | 318/47 |
| 2,540,614 | A * | 2/1951 | Hansell | 310/113 |
| 3,070,741 | A * | 12/1962 | Ford | 322/61 |
| 3,210,629 | A * | 10/1965 | Hornbarger et al. | 318/46 |
| 3,252,066 | A * | 5/1966 | Charlton | 318/732 |
| 6,933,644 | B2 * | 8/2005 | Kanebako | 310/90.5 |
| 7,117,003 | B2 | 10/2006 | Kayama et al. | |
| 7,210,653 | B2 | 5/2007 | Atkey et al. | |
| 2004/0119454 | A1 | 6/2004 | Chang et al. | |
| 2010/0219704 | A1 * | 9/2010 | Han et al. | 310/48 |
| 2011/0018270 | A1 * | 1/2011 | Corcelles Pereira et al. | 290/44 |

FOREIGN PATENT DOCUMENTS

| | | |
|---|---|---|
| DE | 30 02 527 | 8/1980 |
| DE | 198 21 952 | 11/1999 |

OTHER PUBLICATIONS

German Office Action from the German Patent Office in the corresponding priority application 10 2009 002 208.2-32.

* cited by examiner

*Primary Examiner* — Jean F Duverne
(74) *Attorney, Agent, or Firm* — Greer, Burns & Crain Ltd.

(57) ABSTRACT

The present invention relates in to a device for supplying mechanical power to start at least one engine, with a power supply device for supplying electrical power with an alternating voltage and constant frequency; and with a number, N1, of conversion devices for the conversion of the supplied electrical power to a respective mechanical power for a respective engine, wherein a respective conversion device has a cascade starter generator for direct conversion of the supplied electrical power to mechanical power, wherein the cascade starter generator has a first stator, a second stator, a first rotor and a second rotor, the first stator being integrally formed with the second stator and the first rotor being integrally formed with the second rotor. The present invention further relates to an aircraft comprising such a power distribution network and a method for supplying mechanical power to start at least one engine in an aircraft.

13 Claims, 4 Drawing Sheets

DEVICE AND METHOD FOR CONVERTING SUPPLIED ELECTRICAL POWER INTO MECHANICAL POWER TO START AT LEAST ONE ENGINE

CROSS-REFERENCE TO RELATED APPLICATIONS

This application claims the benefit of U.S. Provisional Application No. 61/166,861, filed Apr. 6, 2009, the entire disclosures of which is herein incorporated by reference.

FIELD OF THE INVENTION

The present invention relates to a device and a method for supplying mechanical power to start at least one engine.

Although it can be applied to any fields, the present invention is explained in greater detail with reference to an aircraft and in particular a passenger aircraft.

In aircraft with pneumatic systems, the engines are started with compressed air. In this process the pneumatic lines in the pneumatic system are filled with compressed air which is then passed to the engine. The compressed air is converted to mechanical shaft power via a compressed air motor in the engine.

The process of mechanical power delivery is continued until the thermodynamic process in the engine can be maintained independently. The pneumatic power to start the engine in this process can be generated by an auxiliary power unit. Alternatively, the pneumatic power can be delivered by an engine which is already running and conveyed to the engine to be started by means of corresponding cross-connections. Another alternative is to use external compressed air connections from ground supply units and thus admit compressed air into the aircraft's internal compressed air system and use this to start the engine.

Modern aircraft with considerable electrification, especially with a completely electrical air-conditioning system and electrical wing de-icing, only have a reduced pneumatic system or virtually no pneumatic system at all. In such aircraft, an engine is started using electrical power by means of starter generators. These generators are not only used to generate electrical power and network supply, but are also used to start the engines by reversing the power flow. In this process, electrical power is supplied to the respective generator, which acts as a motor in this case, converting this to mechanical power such that a torque is produced in the engine shaft.

The process of power delivery is traditionally continued until the thermodynamic process in the engine can be maintained independently. A power supply device or a power distribution device is required in this process to supply the electrical power. A power supply device of this type may take the form of an auxiliary power unit which is connected to the respective generator via power distribution buses. Alternatively, the electrical power can also be delivered by an engine which is already running by means of its generator and supplied to the starter generator of the other, non-running engine via electrical power distribution buses. Another alternative entails supplying electrical power by means of ground supply units and the aircraft's external electrical connections and thus feeding electrical power into the aircraft's internal power distribution buses and hence supplying the engine to be started.

Considered as a whole, the technical scope of the present invention relates to electrical engine starting which requires an electrical power supply device.

Traditional electrical power supply devices, power distribution devices or power distribution networks can be divided into three main groups. The first group includes alternating voltage networks with a constant network frequency. The second includes alternating voltage networks with variable frequency and the third known type are direct voltage networks.

The first type described above, the alternating voltage network with constant frequency, has the particular advantage over an alternating voltage network with variable frequency that all consumers which need to be operated with constant voltage and speed during the aircraft flight can be connected directly to the power distribution network. These consumers include fuel pumps, hydraulic pumps or fans, for example.

These consumers are designed to operate at constant speed. This is automatically the case when they are connected directly to a constant frequency network. The disadvantage of this is that inverters need to be used in the case of variable frequency networks. These reduce efficiency and also increase the cost and overall weight of the aircraft in addition to increasing technical complexity.

In order to set up a constant frequency network, what are known as integrated drive generators (IDGs) are traditionally used, which basically consist of a constant speed gear unit and a generator. In this system, conversion from a variable speed to a constant speed takes place on the generator's mechanical input side. It is also important to have different electrical energy sources available for the aircraft during the flight in order to satisfy current and future requirements.

This is not possible with one engine generator in isolation and requires a combination of other energy sources.

In more recent developments, such as the Airbus A380, IDGs have been replaced by generators without constant speed gear units, so-called variable frequency generators (VFG), which are able to cover the required speed range, for example factor 2, and establish a corresponding network with variable frequency. This does, admittedly, save on the expense of the IDG, but also requires the use of inverters for many consumers, which can once again have a detrimental effect on procurement costs, service costs, the overall weight and operating reliability.

As a modification of the VFGs that have been used up to now, for future generations of aircrafts variable frequency starter generators (VFSGs) are provided. These VFSGs are identical to VFGs in generator mode and, when the engine is in operation, draw mechanical power from said engine, convert it into electrical power and feed the electrical power thus obtained into the variable frequency network. To start the engine, said VFSGs are operated in electric motor mode by converting electrical power into mechanical power to drive the engine.

A further generator design is disclosed in DE 30 02 527 A1. This design involves the use of two separate generator units, each having mutually separated stators and rotors which are arranged in a mutually separated manner in a shared housing. This document relates to a cascade starter generator in which the two individual generators are arranged side by side on a common shaft. The electrical connections of the two stators are guided to the exterior separately, whereas the two rotors are electrically connected by the common shaft.

As mentioned above, the direct voltage network is an alternative to alternating voltage networks. However, as neither direct voltage motors nor direct voltage generators with commutators should be used in commercial aircraft, since these are very maintenance-intensive and thus cost-intensive due to the carbon brushes they require, brushless DC technology is used.

In this case the generator or motor is operated with alternating voltage which is generated by special motor control units from a direct voltage network, for example 270 V.

The combination of a direct voltage network and an alternating voltage generator on the one hand and a brushless DC motor on the other hand results in multiple power conversion. A direct voltage is initially generated from the generator alternating voltage by means of a rectifier and this voltage is then distributed accordingly to the motor control units of the relevant components. However, the disadvantage of this multiple conversion is that it causes additional energy losses and requires further technical outlay, which can lead to further detrimental procurement and service costs and extra weight.

These motor control units then generate the individual alternating voltage to drive and control the motor itself.

In any event, such direct voltage networks have the disadvantage that arcing can occur during switching operations which is not extinguished automatically, but requires complex switching elements to suppress this effect.

These additional switching elements which are required lead to further detrimental procurement and service costs and can also give rise to extra weight. Furthermore, these necessary switching units cannot yet be used fully in aviation because they have not yet reached the necessary level of service series maturity for use in the aviation industry.

Documents U.S. Pat. No. 5,977,645 A, U.S. Pat. No. 7,116,003 B2 and U.S. Pat. No. 7,210,653 B2 describe combinations of the networks described above. Documents U.S. Pat. No. 3,571,693 A, U.S. Pat. No. 5,627,744 A and U.S. Pat. No. 7,045,925 B2 also describe constant frequency networks in which the conversion of variable to constant frequency takes place on the generator's electrical output side.

SUMMARY OF THE INVENTION

In view of the above, the object of the present invention is to provide a more efficient and in particular more compact way to supply mechanical power to start an engine.

According to the invention, this object is achieved by a device with the features in claim 1 and/or by an aircraft with the features in claim 12 and/or by a method with the features in claim 13.

A device for supplying mechanical power to start at least one engine, particularly in an aircraft, is accordingly proposed, with a power supply device for supplying electrical power with an alternating voltage and constant frequency; and with a number, N1, of conversion devices for the conversion of the supplied electrical power to a respective mechanical power for a respective engine, a respective conversion device having a cascade starter generator for direct conversion of the supplied electrical power to mechanical power, the cascade starter generator having a first stator, a second stator, a first rotor and a second rotor, the first stator being integrally formed with the second stator and the first rotor being integrally formed with the second rotor.

An aircraft with a power distribution network is also proposed which has a device for supplying mechanical power to start at least one engine as explained above.

A method for supplying mechanical power to start at least one engine in an aircraft, in particular by means of a device according to the invention for supplying mechanical power, is also proposed, this method comprising the following stages: supply of electrical power with an alternating voltage and constant frequency; and conversion of the supplied electrical power to a respective mechanical power for a respective engine, an initial part of the supplied electrical power being converted directly to an initial part of the mechanical power by means of a cascade starter generator and a second part of the supplied electrical power being passed through a frequency converter and then converted to a second part of the mechanical power by means of the cascade starter generator.

In contrast to the prior art mentioned at the outset, an integrated circuit design is used for the mutually integrated rotors and stators in the cascade starter generator according to the invention. In a way, this cascade starter generator has only a single stator and a single rotor, the stator and rotor being formed by two separate stator units and rotor units respectively, which can also be activated separately. This results in considerably simpler circuitry for the motor, since it is not necessary to connect the various rotors electrically via the mechanical shaft. In addition, this makes it possible to achieve a significantly more compact configuration, which is particularly advantageous for use in aircraft.

In comparison to a conventional starter generator, the use of a cascade starter generator/motor of this type also has the benefit that the main power of the cascade generator/motor is fed directly into the network or is drawn therefrom at the synchronous frequency, in both motorised operation and generator operation. Only the power difference needs to be passed via the frequency converter. This means that this frequency converter can be designed to be considerably smaller, thus reducing thermal losses and the weight to be installed. The cascade starter generator/motor and the frequency converter are both designed in a suitable fashion according to the working points required, in particular with respect to the selection of the synchronous speed.

The benefits of using a cascade starter generator/motor of this type become clearer as the power requirements increase, as in future generations of aircraft, which tend to contain a decreasing number of increasingly powerful engines. High torque is also required to start very large engines in particular. In this case, the dimensions of the cascade starter generator may advantageously be selected in such a way that it is designed to be suitable for starting the engine as desired and thus suitable for the starting torque required for the corresponding engine.

One advantage of the present invention is also that it combines the benefits of a constant frequency network—alternating voltage network with constant frequency—with the benefits of a starter generator without a constant speed gear unit—cascade starter generator in motorised operation.

The device for supplying mechanical power according to the invention also makes it possible to provide mechanical power to restart a specific engine irrespective of the flight altitude and any other engines which are (still) running. This has the advantage of increasing the operational safety of the aircraft.

According to the invention, the cascade starter generator is configured in such a way that the first stator and the second stator on the one hand, and the first rotor and second rotor on the other are respectively formed integrally in a single-piece unit, i.e. what is known as a winding assembly. However, the various windings of the first and second stators, like the windings of the first and second rotors, are mutually electrically isolated and thus separate.

By integrating the two stators in a single stator and integrating the two rotors in a single rotor, the cascade starter generator can have a lighter, extremely compact configuration, which is an important factor in the field of aviation. Furthermore, the electric circuitry of the rotors is significantly simplified by this cascade starter generator configuration, since the rotors no longer need be electrically connected by the shaft of the cascade starter generator, as is the case in known solutions.

In addition, the construction costs for the cascade starter generator are also significantly reduced, as considerably less material is required for cascade starter generators with stators and rotors that have been combined to form a unit.

According to the invention it is also possible to use one or more fuel cell stacks as an additional energy source as part of the power supply device according to the invention. As explained in greater detail below, the power supply device may incorporate one or more fuel cell stacks in its network architecture which make it possible to adjust the power supplied to the individual buses flexibly to the power requirements of the associated engines as consumers. This results in improved utilisation of the available power and increased redundancy.

A further advantage of the present invention is that, in the device according to the invention, only one single network type, i.e. an alternating voltage network with constant network frequency, is used as the source for the mechanical power to be supplied in order to start the engine and thus it is not necessary to perform conversions between power networks. This has the advantage of leading to considerably reduced energy losses.

In the device according to the invention, as described above, cascade starter generators are used as engine starter generators. Using a cascade motor to start an engine leads to reduced inverter usage as the inverter to be provided only needs to be designed for part of the power to be supplied to the motor. This leads to a more efficient use of the supplied power as fewer power losses occur. This also leads to a reduction in weight, which has a positive effect on the overall weight and overall efficiency of an aircraft. The respective cascade starter generator is adapted for motorised operation and for generator operation. Cascade starter generators are based on the motor design described in the Fräger, Carsten publication: "Neuartige Kaskadenmaschine für bürstenlose Drehzahlstellantriebe mit geringem Stromrichteraufwand" (*Novel cascade machine for brushless variable speed drives with minimal power converter requirements*), Düsseldorf, VDI-Verlag, 1995 and in document U.S. Pat. No. 7,045,925 B2. Its applicability to generators is illustrated in Fräger, Carsten, "Kaskadengenerator für Windenergieanlagen" (*Cascade generator for wind power plants*), Antriebs-und Schaltungstechnik (*Drive and circuit engineering*), Vol. S2/2006, Berlin, VDI-Verlag.

The advantage of this configuration lies in the fact that the generator's main power is fed directly into the network in both motorised operation and generator operation at the synchronous frequency of the generator, the shaft of this generator being connected to the aircraft engine. Only the power difference needs to be passed via the frequency converter. This means that this can be designed to be considerably smaller, thus reducing thermal losses and the weight to be installed. In this case, the engine, the generator and the gear unit between the two are preferably designed such that the generator is driven at synchronous speed when the engine is operating at cruising speed.

The benefits of using a cascade starter generator/motor as an engine starter generator become clearer as the design power requirements increase. The present invention is particularly advantageous in large mechanical engines which require a high torque to start.

Advantageous embodiments, developments and improvements of the subject-matter according to the invention are described in the further sub-claims.

In a preferred embodiment, at least one conversion device comprises a frequency converter. The cascade starter generator is arranged and configured in the conversion device so as to convert a first part of the supplied electrical power into a first part of the mechanical power and to convert a second part of the supplied electrical power, which has first been passed through the frequency converter, into a second part of the mechanical power.

In a further preferred embodiment, the first stator and the second stator each comprise mutually separated electrical connections.

In a further preferred embodiment, a shared housing is provided, in which the first and second stators and/or the first and second rotors are arranged.

In a further preferred embodiment, the windings of the first and second stators are interwound in such a way that they form a coherent stator winding assembly. In addition, or as an alternative thereto, the windings of the first and second rotors are interwound in such a way that they form a coherent, integrated rotor winding assembly.

According to a preferred development, a power supply device with a plurality of power supply units for respectively supplying electrical power with a constant frequency is provided, with the respective power supply unit being designed as a conversion device for an engine which is already running and/or one of a number, N2, of fuel cell stacks and/or as one of a number, N3, of connections to connect an external power source to supply electrical power with constant frequency.

Another advantage is that inverters do not need to be provided for the connections to connect one or more external power sources, as the concept according to the invention anticipates that any conversion relating to the external supply takes place on the ground in a corresponding ground supply unit. This has the advantage that components which are only required on the ground do not travel with the aircraft on the flight and thus do not unnecessarily increase the aircraft's fuel consumption or lead to increased development and maintenance costs for the aircraft. This is a particular benefit on long-haul aircraft and is also easy to achieve due to the comparatively small number of hub airports. The incorporation of one or more fuel cell stacks as mentioned above helps to fulfil the requirement for a second independent energy source. This can then preferably take over the role of emergency supply and also the role of the auxiliary power unit if designed accordingly. As a fuel cell stack essentially supplies direct voltage, conversion will be necessary in this case in order to feed into the intended AC network at constant frequency. The fuel cell stack is preferably designed such that the supplied voltage can be converted to the selected network voltage by inversion alone and such that a transformer is not required.

The at least one fuel cell stack can then take over the role of the auxiliary power unit when starting an initial engine independent of ground supply. Given a corresponding safety design, the at least one fuel cell stack can also take over emergency supply for restarting in flight. By combining the engine starter concept with the fuel cell stack, this has the advantage of leading to increased redundancy and dissimilarity of the electrical primary energy sources.

According to a further preferred development, a number, N4, of constant frequency buses are provided to connect the conversion units to the power supply units.

The AC network at constant frequency according to the invention is proposed for the constant frequency buses as this network is ideally suited for operation of consumers, such as motors or cascade motors, and also provides three different voltage systems without conversion. These are preferably the full three-phase system, a single-phase alternating voltage system with phase-to-phase voltage and a similar system with a voltage which is smaller by a factor of $1/\sqrt{3}$. The voltage level for the buses can preferably be freely adjusted, but a network voltage of 230/400 volts is suggested to ensure lower currents and thus a reduced cable weight compared with traditional 115/200 volt networks. This thus provides a variety of voltage systems for the use of different voltages for the individual consumers. Accordingly, every consumer can be supplied with the most suitable voltage for each particular consumer, thus enabling the system as a whole to be further optimised. In addition to constant frequency buses, the connection of at least one low volt direct voltage network with a preferred voltage of 28 volts is proposed to supply the avionics and other electrical control and monitoring units, for example.

According to a further preferred development, a controllable switching device is provided which is designed to switch a respective power supply unit to any one of the number, N4, of constant frequency buses.

The controllable switching device may preferably provide load management to distribute the operational electrical consumers during the engine starting process between the available electrical sources or power supply units to the optimum extent. Inter alia, the controllable switching device is also designed to supply individual consumers separately by means of a power supply unit in order to avoid load-dependent voltage fluctuations. In the event of high total power requirements, such as to allow safe and rapid engine starting under difficult conditions such as extreme cold or airfields located at high altitudes, for example, the present concept for the power supply device with a plurality of power supply units also enables several electrical power sources to be grouped together under one power distribution network or a constant frequency bus.

As a result of the switching device or switching logic according to the invention, it is possible to supply each of the available constant frequency buses from each of the sources in the power supply device. However, two engine generators should not feed the same bus at the same time in this case or be connected to the external supply, as this would require synchronisation of the actual voltage and phase relationship to avoid damaging the components. However, further technical measures would be necessary to ensure synchronisation of this kind, with corresponding effects on increased weight, cost and power losses. The present invention therefore does not connect the networks in this situation.

However, by constructing the fuel cell stack inverter accordingly, it is possible to supply both one bus in isolation from a fuel cell stack and to supply it from a fuel cell stack combined with one of the other sources. In this case, the inverter is preferably operated as a self-commutated inverter in the first instance and in combination with another source as an externally commutated inverter in the second instance.

According to a further preferred development, the number, N4, of constant frequency buses contain an initial quantity, M1, of main buses and a second quantity, M2, of emergency buses.

According to a further preferred development, the controllable switching device switches the respective power supply unit as a function of an established load distribution for a load required to start the at least one engine to any one of the number, N2, of constant frequency buses.

By selecting the fuel cell stack inverter accordingly, it is preferably possible to supply both one bus in isolation from a fuel cell stack and to supply it from a fuel cell stack combined with another source. In this case, the inverter is operated as a self-commutated inverter in the first instance and in combination with another source as an externally commutated inverter in the second instance.

According to a further preferred development, a number, N2, of fuel cell stacks are provided, with the respective fuel cell stack being connected to the switching device by means of an inverter.

According to a further preferred development, the respective inverter is designed as an externally commutated inverter.

BRIEF DESCRIPTION OF THE DRAWINGS

The invention is explained below in greater detail with the aid of embodiments and with reference to the accompanying schematic figures in the drawings, in which.

DESCRIPTION OF EXEMPLARY EMBODIMENTS

Figure 1:
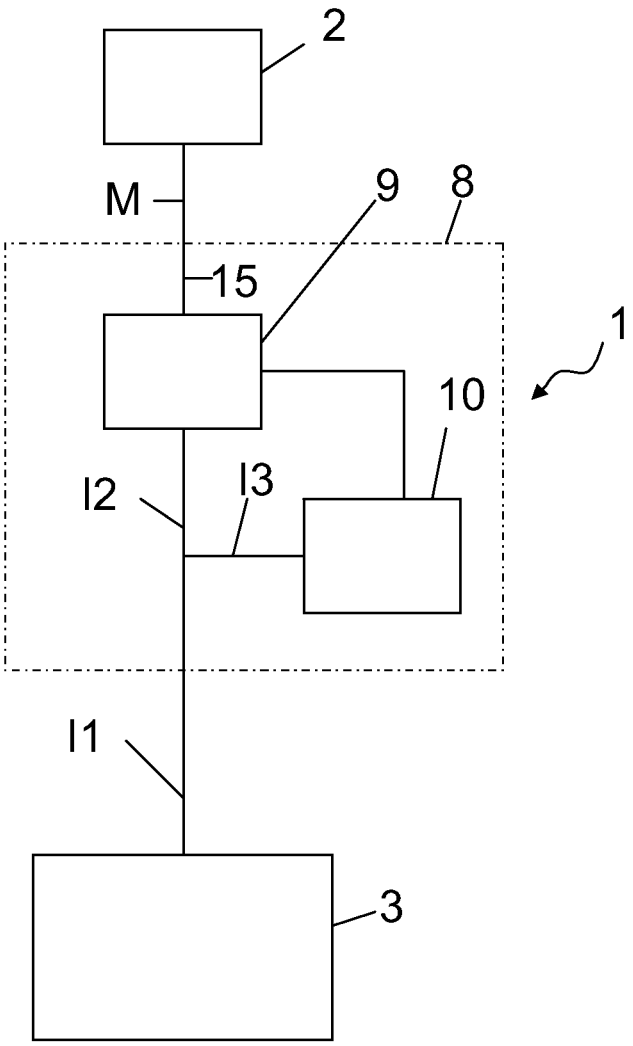
FIG. 1 is a block diagram of an initial embodiment of a device for supplying mechanical power to start at least one engine in an aircraft.

In the figures, the same reference numerals refer to the same members, features or components or members, features or components with the same function, unless otherwise specified.

FIG. 1 represents a block diagram of an initial embodiment of a device 1 for supplying mechanical power M to start at least one engine 2 in an aircraft.

The device 1 has a power supply device 3 and a number, N1, of conversion devices 8.

The power supply device 3 is designed to supply electrical power I1 with an alternating voltage and constant frequency.

The conversion device 8 is designed to convert the electrical power I1 supplied by the power supply device 3 to mechanical power M for the engine 2. To this end the conversion device 8 has a cascade starter generator 9 and a frequency converter 10. A shaft 15 is also provided which connects the engine 2 to the cascade starter generator 9 and which is designed to transfer the mechanical power M to the engine 2. The cascade starter generator 9 is designed to convert, or specifically directly convert, an initial part I2 of the supplied electrical power I1 into an initial part of the mechanical power M. A second part I3 of the supplied electrical power is passed through a frequency converter 10 and then converted into a second part of the mechanical power M by means of the cascade starter generator 9, in such a way as to supply various speeds for the shaft 15.

The supplied electrical power I1 corresponds to the sum of the first part I2 of the electrical power I1 and the second part I3 of the electrical power I1.

Figure 2:
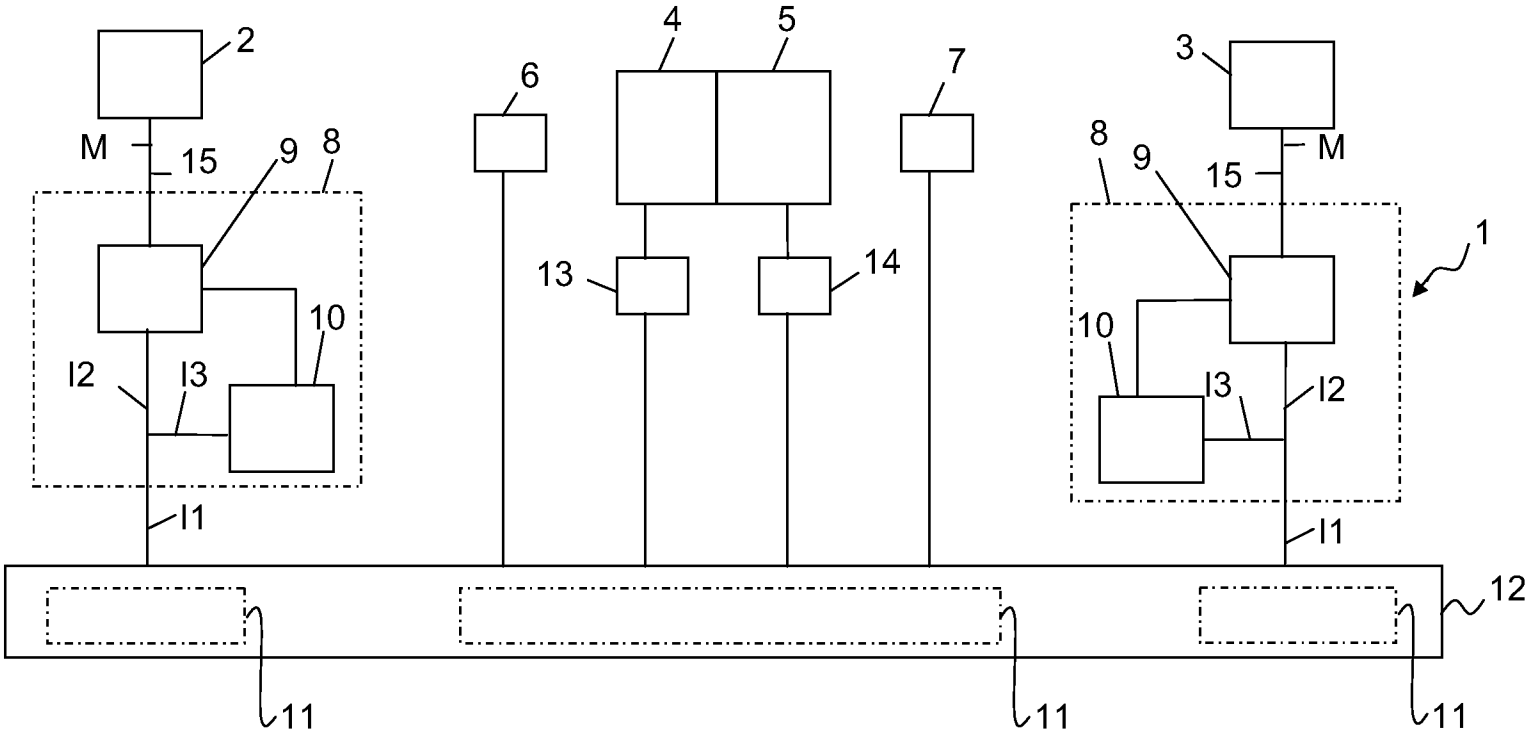
FIG. 2 is a block diagram of a second embodiment of a device for supplying mechanical power to start at least one engine in an aircraft.

FIG. 2 shows a block diagram of a second embodiment of a device 1 for supplying mechanical power M to start at least one engine 2 in an aircraft. The second embodiment shown in FIG. 2 incorporates all the features of the initial embodiment shown in FIG. 1. To avoid repetition, the corresponding features in both embodiments shown in FIGS. 1 and 2 will not therefore be explained again in detail.

According to the second embodiment of the device 1 shown in FIG. 2, the power supply device 3-8 has a plurality of power supply units 3-8 for supplying electrical power I1 with an alternating voltage and constant frequency in each case. In this case the respective power supply unit 3-8 can be designed as a conversion device 8 for an engine 3 which is already running. Alternatively, a power supply unit can also be designed as one of a number, N2, of fuel cell stacks 4, 5. In addition, a respective power supply unit can be designed as one of a number, N3, of connections 6, 7 for connecting an external power source for supplying electrical power I1 with an alternating voltage and constant frequency.

Furthermore, the device 1 preferably has a number, N4, of constant frequency buses 11 which are designed to connect the conversion devices 8 to the power supply units 3-8.

The number, N4, of constant frequency buses 11 preferably have an initial quantity, M1, of main buses and a second quantity, M2, of emergency buses (not illustrated).

In addition, the device 1 preferably has a controllable switching device 12. The controllable switching device is designed to switch a respective power supply unit 3-8 to any one of the number, N4, of constant frequency buses 11.

Furthermore, the controllable switching device 12 is preferably designed to switch at least one power supply unit 3-8 as a function of an established load distribution for the load required to start the at least one engine 2 to any one of the number, N4, of constant frequency buses 11. A defined number and/or selection of power supply units 3-8 are preferably switched to the constant frequency bus 11 by the controllable switching device 12 depending on the established load distribution.

The device 1 preferably has a number, N2, of fuel cell stacks 4, 5. The respective fuel cell stack 4, 5 is connected to the switching device 12 by means of an inverter 13, 14. The respective inverter 13, 14 is preferably designed as an externally commutated inverter.

Without loss of generality, the individual numbers, N1-N4, shown in FIG. 2 are merely given by way of example and are by no means restrictive for the invention.

Figure 3:
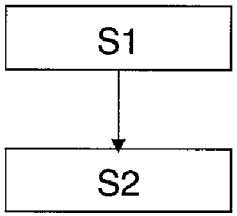
FIG. 3 is a flow chart of an embodiment of a method for supplying mechanical power to start at least one engine in an aircraft.

A schematic flow chart of an embodiment of a method for supplying mechanical power M to start at least one engine 2 is shown in FIG. 3.

The method according to the invention is explained below with the aid of the block diagram in FIG. 3 with reference to the block diagram in FIG. 1. The method according to the invention as shown in FIG. 3 has the following method stages, S1 and S2:

Method Stage S1:

Electrical power I1 with an alternating voltage and constant frequency is supplied.

Method Stage S2:

The supplied electrical power I1 is converted to a respective mechanical power M for a respective engine 2. In this method, an initial part I2 of the supplied electrical power I1 is converted to an initial part of the mechanical power M by means of a cascade starter generator 9. A second part I3 of the supplied electrical power is passed through a frequency converter 10 and then converted into a second part of the mechanical power M by means of the cascade starter generator 9.

Figure 4:
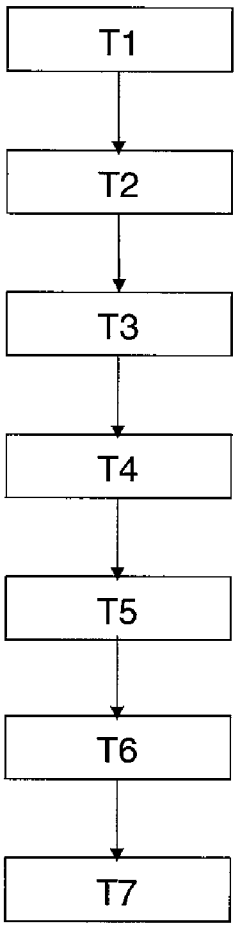
FIG. 4 is a flow chart of an embodiment of a method for distributing power which incorporates the method for supplying mechanical power as shown in FIG. 3.

FIG. 4 shows a schematic flow chart of an embodiment of a method for distributing power which incorporates the method for supplying mechanical power M as shown in FIG. 3.

The embodiment of the method as shown in FIG. 4 has the following method stages, T1 to T7:

Method Stage T1:

A power supply device with a plurality of power supply units for respectively supplying electrical power I1 at a constant frequency is provided. The respective power supply unit is preferably designed as one of a number, N1, of conversion devices 8. Examples of the configuration of the conversion device 8 are disclosed in the unpublished German patent application with file reference 10 2008 043 626.7-32. This disclosure of the embodiments of the conversion device is expressly referred to in this document and applies to the present application.

As an alternative to such a conversion device 8 as a power supply unit, one of a number, N2, of fuel cell stacks 4, 5 and/or one of a number, N3, of connections 6,7 may be used to connect to an external energy source.

Method Stage T2:

A number, N4, of constant frequency buses 11 is provided, with the respective constant frequency bus 11 being designed to transfer the electrical power I1 with constant frequency supplied by the at least one power supply device to the conversion device 8.

Method Stage T3:

A controllable switching device 12 is preferably provided which is designed to switch a respective power supply unit to a respective constant frequency bus 11. As a result of the switching device 12 or switching logic according to the invention, it is possible to supply each of the available constant frequency buses 11 from each of the sources in the power supply units.

Method Stage T4:

A number, N1, of conversion devices 8 are provided. The respective conversion device 8 has a cascade starter generator 9 for direct conversion to an initial mechanical power M of an initial part of a supplied electrical power I1 with an alternating voltage and constant frequency. A second part I3 of the supplied electrical power I1 is passed through a frequency converter 10 and then converted to a second part of the mechanical power M by means of the cascade starter generator 9, such as to adjust deviations in the speed of an output shaft of the conversion device from the synchronous speed.

Method Stage T5:

A number, N6, of engines 2, 3 is provided. The respective engine 2, 3 is connected to one of the conversion devices 8 with a cascade starter generator 9 (see FIG. 2). At least one of the engine shafts 15 of the engine 2, 3 is made to rotate and accelerated to a minimum speed by means of the mechanical power M supplied by the conversion device 8, such that the respective engine 2, 3 can be started by means of additional fuel injection and ignition of the combustion method.

Method Stage T6:

As soon as the engine 2, 3 is started by means of the respective conversion device 8, the respective conversion device 8 can be switched from motorised to generator operation. In so doing, the conversion device 8 itself becomes a power supply unit.

Method Stage T7:

In a preferred embodiment of the switching device or switching logic 12 provided in the above stage T3, at least one conversion device 8 is supplied in parallel with the other constant frequency buses 11, with power being provided by a combination of the power supply units provided in the above stage T1.

A system is also proposed which has the device for supplying mechanical power of the present application and a power distribution device according to the parallel, not yet disclosed, German patent application with file reference 10 2008 043 626.7-32, disclosure of the latter being fully and expressly referred to in this document.

Figure 5:
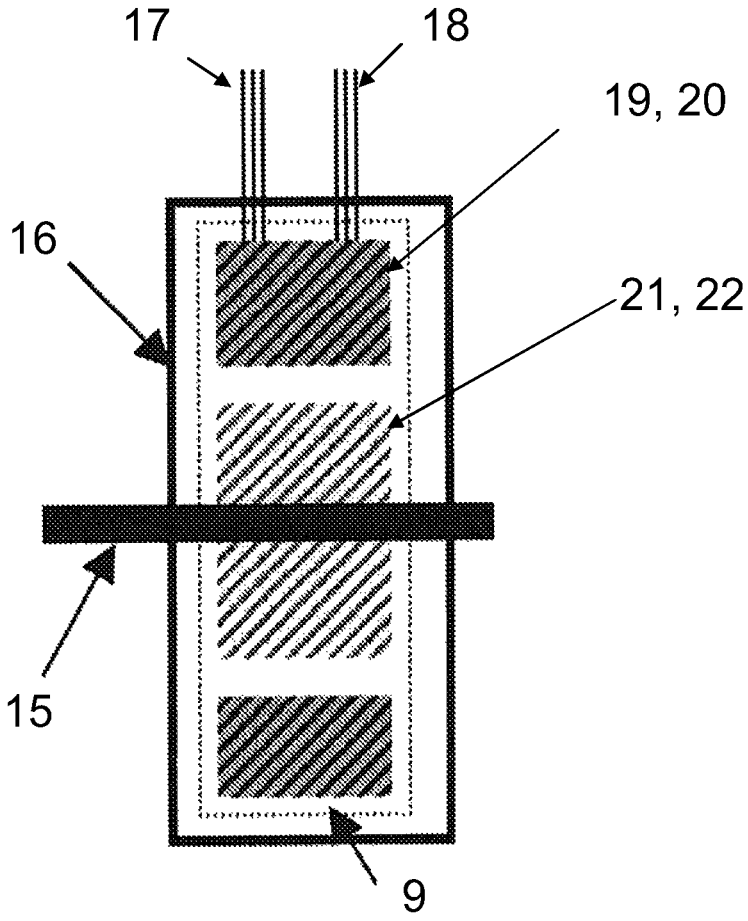
FIG. 5 is a block diagram of a cascade starter generator.

FIG. 5 is a schematic diagram of a cascade starter generator 9 according to the invention. In this case, the cascade starter generator 9 is arranged in a shared housing 16. The cascade starter generator 9 shown comprises a first stator 19 and a second stator 20 which are formed integrally and therefore can be viewed to some extent as being a single stator. The windings of the first stator 19 are preferably electrically isolated from the windings of the second stator 20. The first stator 19 has a first electrical connection 17. The second stator 20 has a second electrical connection 18. The integral configuration of the first and second stators 19, 20 as a single, preferably single-piece, stator makes it possible to construct said stator in a particularly compact way reducing material. This compact configuration reduces the weight of the entire cascade starter generator 9 significantly.

A rotor arranged on a common shaft 15 is also shown in FIG. 5. The rotor comprises the first rotor 21 and the second rotor 22. The first rotor 21 and the second rotor 22 are also formed integrally as a single, preferably single-piece, rotor. The integral configuration of the first rotor 21 with the second rotor 22 also makes it possible for the rotor produced therefrom to be formed in a particularly compact, lighter manner using less material. In this configuration, it is also possible for the electrical circuitry of the first rotor 21 and the second rotor 22 of the cascade starter generator 9 to be formed in a particularly simple manner, since there are no excessive distances between the two rotors 21, 22 in this case.

In this way, a new, integrated generator design for a cascade generator is provided according to the invention, in which the individual rotors and stator coils are integrated with one another rather than being arranged separately, as in the corresponding rotor and stator coils in DE 30 02 527 A1 described at the outset. This integration is achieved for example in that the individual coil windings of the rotors 21, or the stators 19, 20 are interwound or at least are interconnected or arranged one inside the other in such a way that a dense winding assembly is achieved for the rotor 21, 22 or the stator 19, 20. The particular benefit of this arrangement is that the respective rotors or stators of the two electrical machines resulting therefrom can be operated separately from one another and can thus be activated separately from one another, which is a particular benefit when using a power distribution network according to the invention. However, it is also advantageously possible to operate the electrical machines containing the two integrated stators 19, 20 or rotors 21, 22 as a single electric motor. This integrated arrangement of the stators 19, 20 and rotors 21, 22 makes it possible to configure the cascade starter generator in a more efficient manner overall, and offers significant benefits, particularly with respect to total weight and the installation space required.

It is advantageously possible to operate the cascade starter generator 9 both in generator mode and in electric motor mode.

Although the present invention has been described by means of preferred embodiments, it is not limited to these embodiments, but may be modified in multiple ways.

LIST OF REFERENCE NUMERALS

1 Device
2 Engine
3 Engine
4, 5 Fuel cell stack
6, 7 (External) connection
8 Conversion device
9 Cascade starter generator
10 Frequency converter
11 Constant frequency bus
12 Switching device
13, 14 Inverter
15 Shaft
16 Housing
17 First electrical connection
18 Second electrical connection
19 First stator
20 Second stator
21 First rotor
22 Second rotor
I1 Electrical power
I2 Initial part of electrical power
I3 Second part of electrical power
M Mechanical power
S1, S2 Method stage

The invention claimed is:

1. A device for supplying mechanical power to start at least one engine, comprising:

a power supply device for supplying electrical power with an alternating voltage and constant frequency; and a number, N1, of conversion devices for the conversion of the supplied electrical power to a respective mechanical power for a respective engine, each conversion device having a cascade starter generator for direct conversion of the supplied electrical power to mechanical power, each cascade starter generator having a first stator, a second stator, a first rotor and a second rotor, the first stator being integrally formed with the second stator and the first rotor being integrally formed with the second rotor, wherein at least one of said conversion devices comprises a frequency converter, and wherein the cascade starter generator converts a first part of the supplied electrical power into a first part of the mechanical power and a second part of the supplied electrical power, which has first been passed through the frequency converter, into a second part of the mechanical power.

2. The device according to claim 1, wherein the first stator and the second stator each comprise mutually separated electrical connections.

3. The device according to claim 1, wherein a shared housing is provided, in which the first and second stators and/or the first and second rotors are arranged.

4. The device according to claim 1, wherein the windings of the first and second stators are interwound in such a way that they form a coherent stator winding assembly, and/or in that the windings of the first and second rotors are interwound in such a way that they form a coherent, integrated rotor winding assembly.

5. A device for supplying mechanical power to start at least one engine, comprising:

a power supply device for supplying electrical power with an alternating voltage and constant frequency; and a number, N1, of conversion devices for the conversion of the supplied electrical power to a respective mechanical power for a respective engine, each conversion device having a cascade starter generator for direct conversion of the supplied electrical power to mechanical power, each cascade starter generator having a first stator, a second stator, a first rotor and a second rotor, the first stator being integrally formed with the second stator and the first rotor being integrally formed with the second rotor, wherein the power supply device has a plurality of power supply units for respectively supplying electrical power at constant frequency, with the respective power supply unit being designed as a conversion device for an engine which is already running and/or as one of a number, N2, of fuel cell stacks and/or as one of a number, N3, of connections to connect an external energy source to supply the electrical power at constant frequency.

6. The device according to claim 5, wherein a number, N4, of constant frequency buses for connecting the conversion devices to the power supply units are provided.

7. The device according to claim 6, wherein the number, N4, of constant frequency buses have an initial quantity, M1, of main buses and a second quantity, M2, of emergency buses.

8. The device according to claim 6, wherein a controllable switching device is provided which is designed to switch a respective power supply unit to any one of the number, N4, of constant frequency buses.

9. The device according to claim 7, wherein the controllable switching device switches at least one power supply unit as a function of an established load distribution for a load required to start the at least one engine to any one of the number, N4, of constant frequency buses.

10. The device according to claim 7, wherein a number, N2, of fuel cell stacks are provided, wherein the respective fuel cell stack is connected to the switching device by means of an inverter which is preferably designed as a self-commutated inverter.

11. The device according to claim 10, wherein the respective inverter is designed as an externally commutated inverter.

12. An aircraft with a power distribution network which has a device according to claim 1.

13. A method for supplying mechanical power to start at least one engine in an aircraft by means of a device for supplying mechanical power to start at least one engine, comprising a power supply device for supplying electrical power with an alternating voltage and constant frequency; and a number, N1, of conversion devices for the conversion of the supplied electrical power to a respective mechanical power for a respective engine, each conversion device having a cascade starter generator for direct conversion of the supplied electrical power to mechanical power, each cascade starter generator having a first stator, a second stator, a first rotor and a second rotor, the first stator being integrally formed with the second stator and the first rotor being integrally formed with the second rotor, with the following stages:

a) supplying electrical power with an alternating voltage and constant frequency;

b) converting the supplied electrical power to a respective mechanical power for a respective engine, wherein an initial part of the supplied electrical power is converted directly to an initial part of the mechanical power by means of a cascade starter generator and a second part of the supplied electrical power is passed through a frequency converter and then converted to a second part of the mechanical power by means of the cascade starter generator.

* * * * *